US005390468A

United States Patent [19]

Probst

[11] Patent Number: 5,390,468

[45] Date of Patent: Feb. 21, 1995

[54] FACING ELEMENT FOR FLOORS, CEILINGS, WALLS AND THE LIKE

[76] Inventor: Thilo Probst, Herrenstasse 33, 87439 Kempton, Germany

[21] Appl. No.: 105,595

[22] Filed: Aug. 12, 1993

[30] Foreign Application Priority Data

Aug. 13, 1992 [DE] Germany ..... 4226742

[51] Int. Cl.[6] ..... E04C 2/36; B32B 3/12

[52] U.S. Cl. ..... 52/808; 52/506.1; 52/511; 52/806; 428/116; 428/118

[58] Field of Search ..... 52/235, 506.01, 508, 52/511, 513, 806, 808, 787, 506.06, 506.1; 428/116, 117, 118

[56] References Cited

U.S. PATENT DOCUMENTS

| | | | |
|---|---|---|---|
| 2,140,709 | 12/1938 | Mauser | 52/787 |
| 2,793,718 | 5/1957 | Pajak | 428/116 X |
| 3,078,002 | 2/1963 | Rodgers, Jr. | 52/787 |
| 3,579,942 | 5/1971 | Cole | 52/806 X |
| 3,723,233 | 3/1973 | Bourke | 52/806 X |
| 3,963,846 | 6/1976 | Bourke | 52/806 X |
| 4,822,661 | 4/1989 | Battaglia | 428/116 |
| 4,925,721 | 5/1990 | Harper-Tervet et al. | 428/116 |

FOREIGN PATENT DOCUMENTS

| | | | |
|---|---|---|---|
| 0406991A1 | 6/1990 | European Pat. Off. . | |
| 924361 | 8/1947 | France | 52/808 |
| 1279466 | 11/1960 | France . | |
| 2239558 | 1/1974 | Germany | 52/808 |
| 3337875 | 4/1985 | Germany | 428/116 |

*Primary Examiner*—Carl Friedman
*Assistant Examiner*—Kevin D. Wilkens
*Attorney, Agent, or Firm*—Notaro & Michalos

[57] ABSTRACT

A facing element (10) includes a honeycomb carrier plate (12) which is clamped, sandwich-like, between two cover plates (14, 16) by clamping anchors (18). On the upper cover plate (14) is affixed by adhesion, a natural stone plate (22). The honeycomb carrier plate (12) projects at two diagonal edges by projections (21, 23) beyond the cover plate (14). At both other edges of the carrier plate (12), pocket-like depressions (25, 27) are formed which, in form and position, are complementary to the projections (21, 23) at the diagonal plate edges. In the plate connection the projections of a facing element engage the pocket-like depressions (25, 27) of two adjacent facing elements so as to form a form-fit connection whereby a strong plate connection is created.

8 Claims, 8 Drawing Sheets

FACING ELEMENT FOR FLOORS, CEILINGS, WALLS AND THE LIKE

FIELD AND BACKGROUND OF THE INVENTION

The present invention relates in general to facing elements, and in particular to a new and useful facing element for floors, ceilings, walls and the like.

European Patent Document EP 406 991 A1 discloses a facing element of this type. A honeycomb carrier plate comprises regular hexagonal honeycombs. The edges of the carrier plate and a cover plate are flush, which also applies for a stone plate. Consequently, the four plates of the facing element are on all four sides in contact with the same imaginary lateral contact plane. In the case of a floor plate covering, this known facing element requires an adhesive type floor fastening since otherwise due to the absence of a form-fit interdigitation of the facing plates, no surface alignment can be achieved. For wall facings, these facing plates have anchoring means on the rear side with which they can be suspended from a wall fastening rail. Between the individual facing elements of a wall covering of this type remain gaps through which rain water can penetrate into the hollow space between the facing plane and the building wall. Due to the individual suspension of the facing plates, relative motions of the facing elements can occur in the event of wind incident and, depending on the type of suspension, the development of noise through the possibility of relative motion of the plates is also not excluded. In the known facing element the carrier plate and the two cover plates comprise aluminum, and the stone plate is fastened in spots by adhesive means to the upper cover plate and additionally mechanically anchored on the carrier plate.

U.S. Pat. No. 4,601,147 discloses a facing element in which a carrier plate comprises a continuous bottom with a number of webs projecting upwardly from it, on which the stone plate is fastened. The width of the carrier plate and the stone plate is identical, however, the carrier plate comprises at one end of its length a push-in tongue to which is assigned at the other end a lead-in groove for the push-in tongue of an adjacent plate. The carrier plates consequently engage each other in a form-fit manner in their longitudinal directions, however, in the transverse direction longitudinal joints result between the rows of facing elements with the disadvantages described above. In large-format facing elements the carrier plate implementation with the majority of parallel bearing webs has a disadvantage in comparison to a honeycomb bearing element because the stone plate between two bearing webs is not supported over the entire web length.

SUMMARY OF THE INVENTION

It is the task of the invention to implement a facing element of the initially stated type while maintaining a sandwich-construction of the bearing body for the stone plate in such a way that an absolutely flush placing, for example of a floor covering, is also possible without adhesive fastening of the elements, the strength of a plate joint is significantly increased and the facing plate requires comparatively low fabrication costs.

The advantage of the invention resides in that, in spite of a simple implementation of the carrier plate in a continuous casting process from synthetic material, a toothing of the joint is ensured in the row as well as also the column direction, so that the strength of the facing wall is decisively increased. This advantage is achieved in that the outer contour of the carrier plate is greater than that of the cover and stone plates. Since the carrier plate consequently projects at two diagonal edges of the upper cover plate from the latter, these projections reach under the cover plates of two adjacent facing elements. Since the honeycomb structure of the carrier plate leads at the edges of the cover plate to projections distanced from one another at two edges and correspondingly complementary recesses at the two other edges, at all four edges of the facing element a form-fit connection of the carrier plate with the carrier plates of the four adjacent facing elements, takes place.

In addition to this form-fit closure in the plane of the carrier plate, the invention also brings about a form-fit closure at a right angle to the plate plane since two diagonal cover plates are underreached by the projections of the carrier plate of the facing element lying in between. This leads to the fact that with extremely simple means a surface alignment of the plate connection is achieved so that, for example, a floor plate covering with the prefabricated facing plates can be placed in position very quickly since a fastening by adhesion of the facing elements with the floor is omitted. Since the facing element according to the invention can be brought, solely by shifting in the plane of the plate, into the fitting position with the connection, the forms of the projections must be determined so that fitting-in becomes possible at all. This is ensured if at least two parallel plane walls of a honeycomb extend at an acute angle, thus an angle smaller than 90° to the plate edges, and with curved walls wave-form edges are formed in which the tangents at the inflection point of the curve form the acute angle with the plate edges. The method according to the invention resides in that a facing element is brought into the fitting position at an acute angle in the range from approximately 25° to approximately 65° to one of the adjacent straight-line cover plate edges of the connection. In particular when the honeycombs have a regular hexagonal cross section the insertion direction according to the invention coincides with the direction of one of the hexagonal sides which conjoin one of the two parallel sides of the hexagon. Consequently, according to the invention an insertion direction of the facing element at an angle of 30° with the longitudinal edge or the transverse edge of the facing element results, depending on whether or not the parallel sides of the hexagons are oriented in parallel to the longitudinal or to the transverse edge of the facing element. Consequently, if the parallel sides of the hexagons extend parallel to the longitudinal edge of the plate, the insertion direction forms 60° with this longitudinal edge and consequently 30° with the transverse edge.

In principle, the lower cover plate is only required for bracing of the sandwich plate so that, instead of one continuous cover plate, for each anchor element is provided a small abutment plate of its own which is supported on the honeycomb walls of the carrier plate. A relatively more advantageous solution, however, uses a bottom cover plate of identical format and in the identical contour orientation as the top cover plate so that between the two cover plates in the region of the recesses of the carrier plate, plug-in pockets for the projections are formed on the opposing edge of the next facing element. Consequently after insertion into the sandwich at two diagonal edges, each facing element is immovably interleaved in a form-fit manner and since the next facing plates are correspondingly anchored at the two remaining edges of the above stated facing element, an encircling form-fit closure connection results.

An important further development of the invention resides in that the stone plate is disposed on the top cover plate so as to be diagonally offset. The diagonal offset is preferably chosen so that the stone plate projects above the top cover plate at the two edges where also the projections of the carrier plate are formed. Since the diagonal offset of the stone plate with respect to the cover plate is only so large that the projections of the carrier plate still project over the contour of the stone plate, the latter is protected against damage. This diagonal offset of the stone plate increases the effect of interleaving since now the stone plate of a facing element overlaps the cover plates of two adjacent facing elements and the cover plate of this facing element is overlapped at the two remaining edges by the stone plates of adjacent facing elements. Moreover, this further development ensures a better sealing against penetration of moisture since, in the plate connection, the joints of the stone plates are offset relative to those of the cover plates.

With other features of the invention, a very comfortable suspension system for the facing elements is achieved wherein mounting rails can be mounted vertically as well as also horizontally on a building wall and the oblique slots in the mounting rails ensure the rapid fitting-in of the facing elements since these are guided through the oblique slots in the correct fit-in direction, into the fitting position. The oblique slots extend downward toward the longitudinal center of the mounting rails so that the weight of the facing elements secures these in their fitting position. Due to the interleaving all around of each facing element in the connection, a facing wall of high strength and absolutely flush on the surface results.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS

In conjunction with the drawings, which depict embodiments of the invention, the invention will be described in further detail. In the drawings.

DESCRIPTION OF THE PREFERRED EMBODIMENTS

Figure 1:
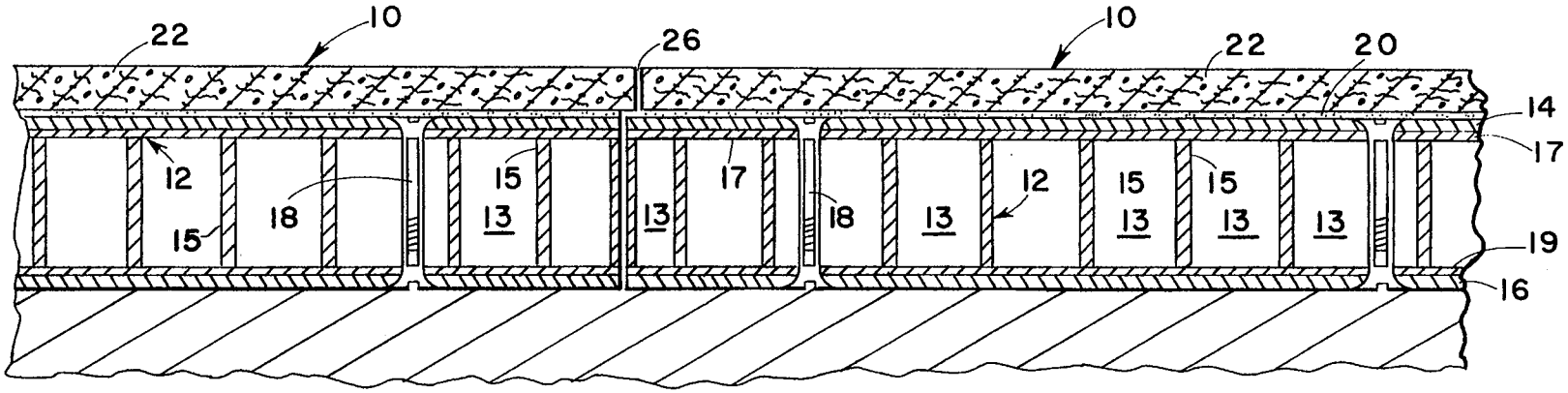
FIG. 1 is a sectional view through a facing element connection of the invention.

A facing element 10 comprises a honeycomb carrier plate 12 of synthetic material as well as two cover plates 14, 16 placed on opposing face sides between which the carrier plate 12 is enclosed, sandwich-like. The two cover plates 14, 16 are clamped enclosing the carrier plate 12 by means of clamping anchors 18. Onto the top plate 14 is applied an adhesive means layer 20 by means of which a natural stone plate 22 is fastened by adhesion on the plate 14, which is made of metal.

Figure 3:
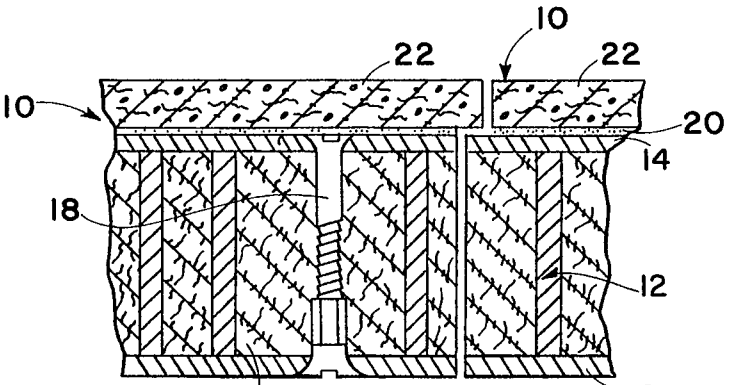
FIG. 3 is an enlarged sectional view at the abutment site of two facing elements of a connection.
Figure 2:
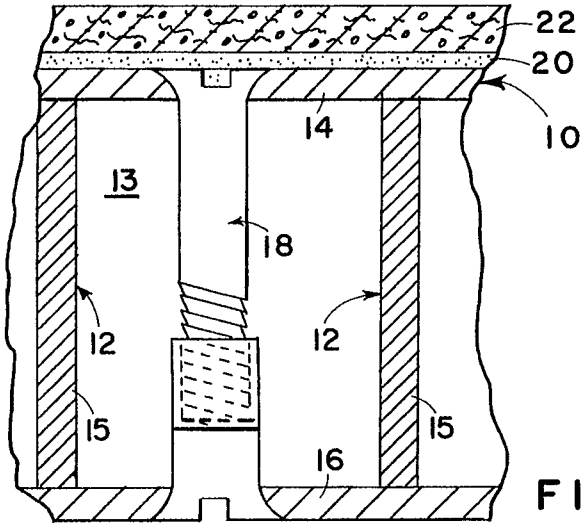
FIG. 2 is a sectional view on a larger scale through a facing element.

The carrier plate 12 comprises a number of hollow spaces 13, which are closed off around their periphery by strong partition walls 15. The hollow spaces 13 form tubes with uniform cross section. In the illustrated embodiments a regular hexagonal cross section is used for tubes 13. According to FIG. 1 the carrier plate 12 has a covering 17 integrally connected with the partition walls 15 and provided with apertures and a corresponding bottom 19. The two cover plates 14, 16 can additionally be affixed to them by adhesion. In the representation according to FIG. 2 and 3 the cover 17 and bottom 19 are omitted and the metal plates 14, 16 are only mechanically clamped through the clamping anchors 18 on the carrier plate 12. In FIG. 3 the hollow spaces 13 are filled with an insulating material in order to increase the thermal and impact sound insulating properties.

The facing elements are prefabricated in series and can be placed simply in position by sliding them together on site wherein the carrier plates of each two adjacent facing elements 10 engage each other in a form-fitting way so that a strong connection is created. The metal plates 14, 16 project at two diagonal edges beyond the stone plate 22 and are correspondingly set back at the two other edges opposing them so that the abutment joint between two stone plate 22 at the bottom side is closed through the projecting metal plate 14 of the one facing element. The joint has the reference number 26.

Figure 4:
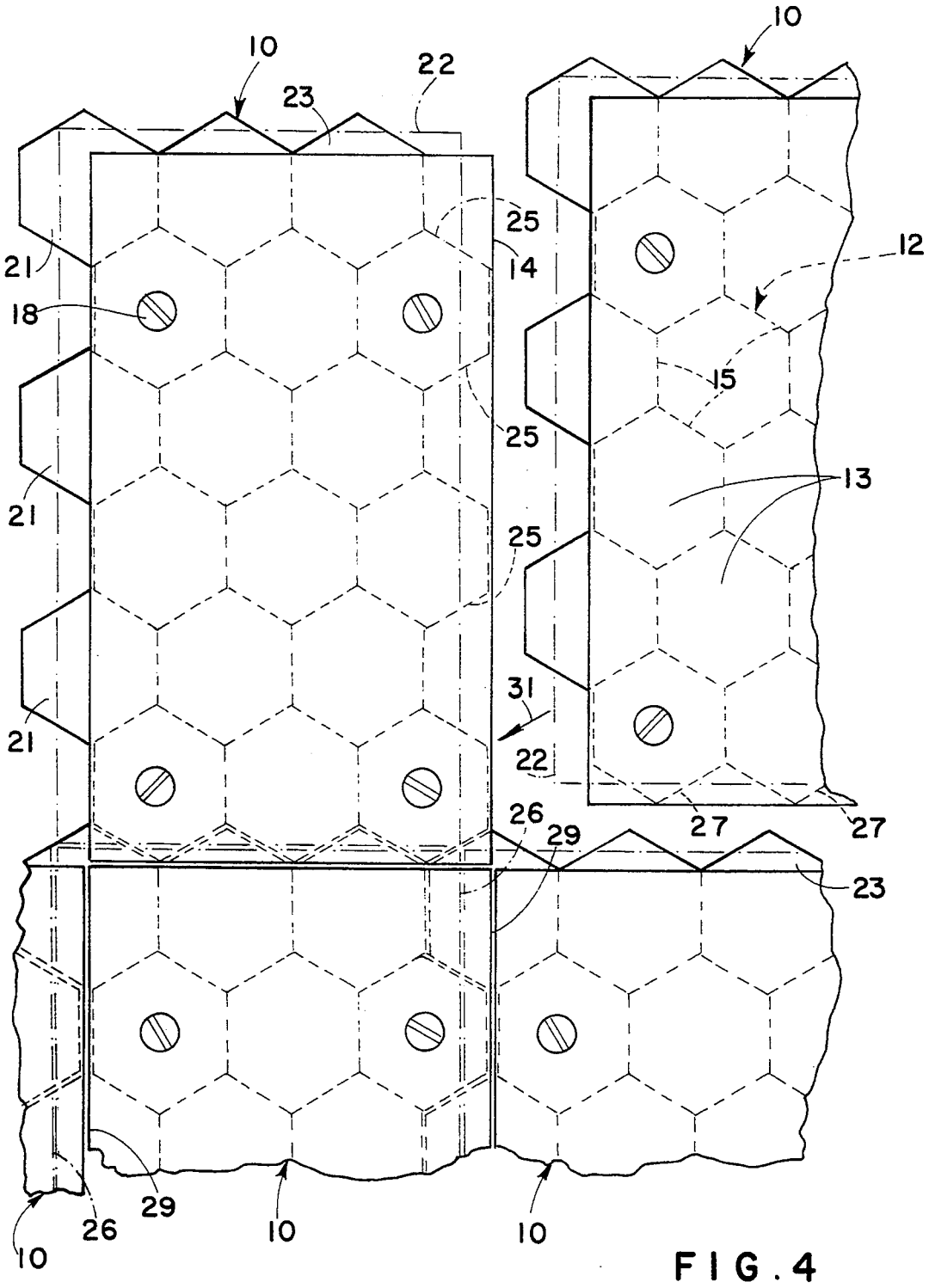
FIG. 4 is a top view onto a facing element to be set into the connection.

In FIG. 4 the cover plates 14, 16 are drawn in solid lines, between which the joints 29 are formed. Shown in dot-dash lines are the four sides or edges of the stone plates 22 and in dashed lines the walls 15 of the carrier plate 12, which here comprises a section of an extrusion profile.

The cover plates 14, 16 and the stone plates 22 have at least approximately the same rectangular format or shape and the carrier plate 12 is at the outside touched by an imaginary rectangular box whose length and width are greater than the format of the cover plates. The carrier plate 12 projects at two diagonal edges or sides beyond the metal plates 14, 16 and specifically once with trapezoidal projections 21 and, for another, with triangular projections 23. At the two other edges or sides are provided recesses 25, 27, configured correspondingly, which serve for the form-fit engaging of an attached facing element. As can be seen in FIG. 4, four clamping anchors 18 are sufficient in order to clamp the cover plates 14, 16 with the carrier plate 12. The stone plate 22 is offset diagonally with respect to the cover plates so that the abutment joints 26 between the stone plates 22 are offset with respect to the cover plate joints 29.

Mounting the facing elements into the connection takes place through a sliding motion in the plate plane in only one very particular direction which is indicated in FIG. 4 through the arrow 31. This direction extends parallel to a hexagonal side of a honeycomb which adjoins one of the parallel sides of the hexagon. This plug-in direction forms with the longitudinal edges beyond which project the trapezoidal projections 21 or recesses 25 of the cover plates 14 and 16, an angle of 60° and with the transverse edges of the cover plates to which are assigned the triangular projections 23 and the recesses 27, an angle of 30°. With this one straight sliding motion the facing element 10 is simultaneously interleaved in a form-fit manner at two diagonal edges with the plate connection. The corner honeycomb depicted in the upper left of FIG. 4 combines a projection 21 and a projection 23 and is overlapped by three adjoining cover plates 14, 16.

Figure 5:
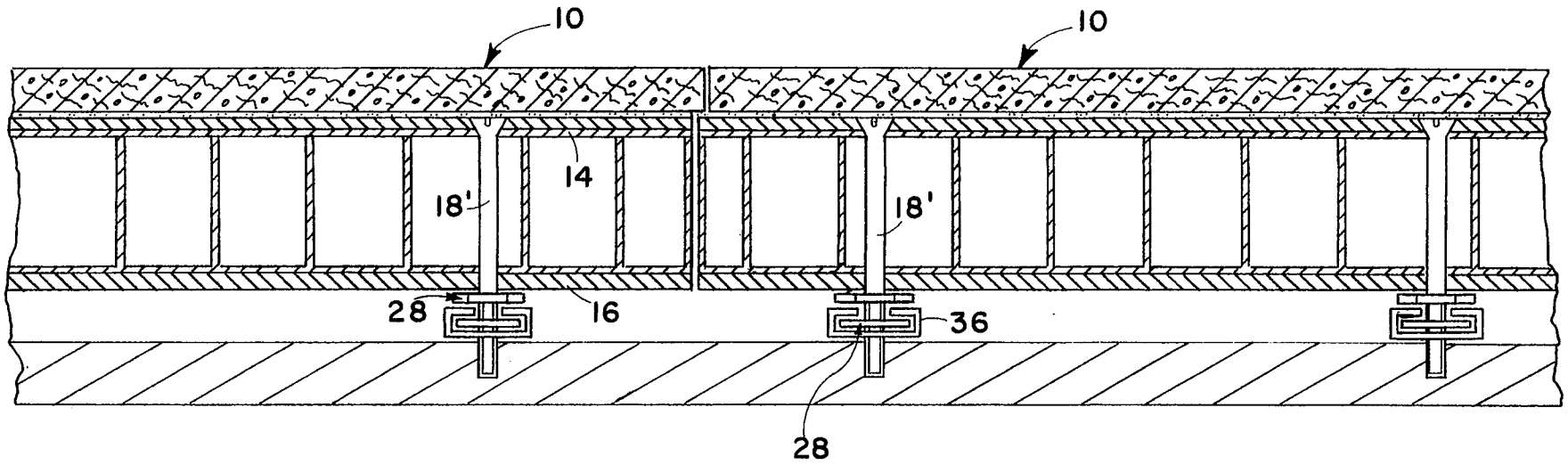
FIG. 5 is a sectional view through a facade plate connection.
Figure 6:
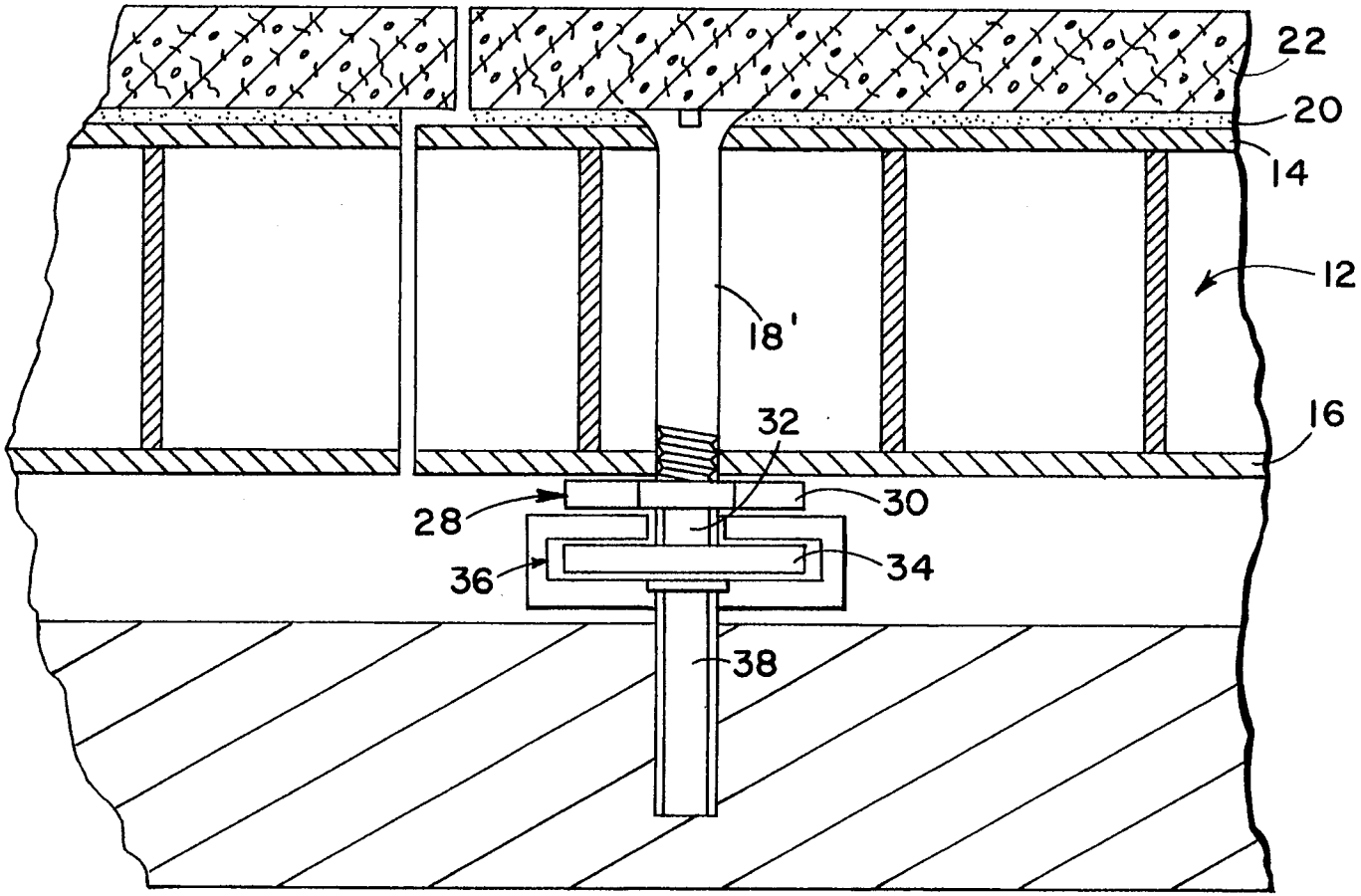
FIG. 6 is a sectional view similar to FIG. 5, however at an enlarged scale with representation of the abutment site and a mechanical anchor.
Figure 9:
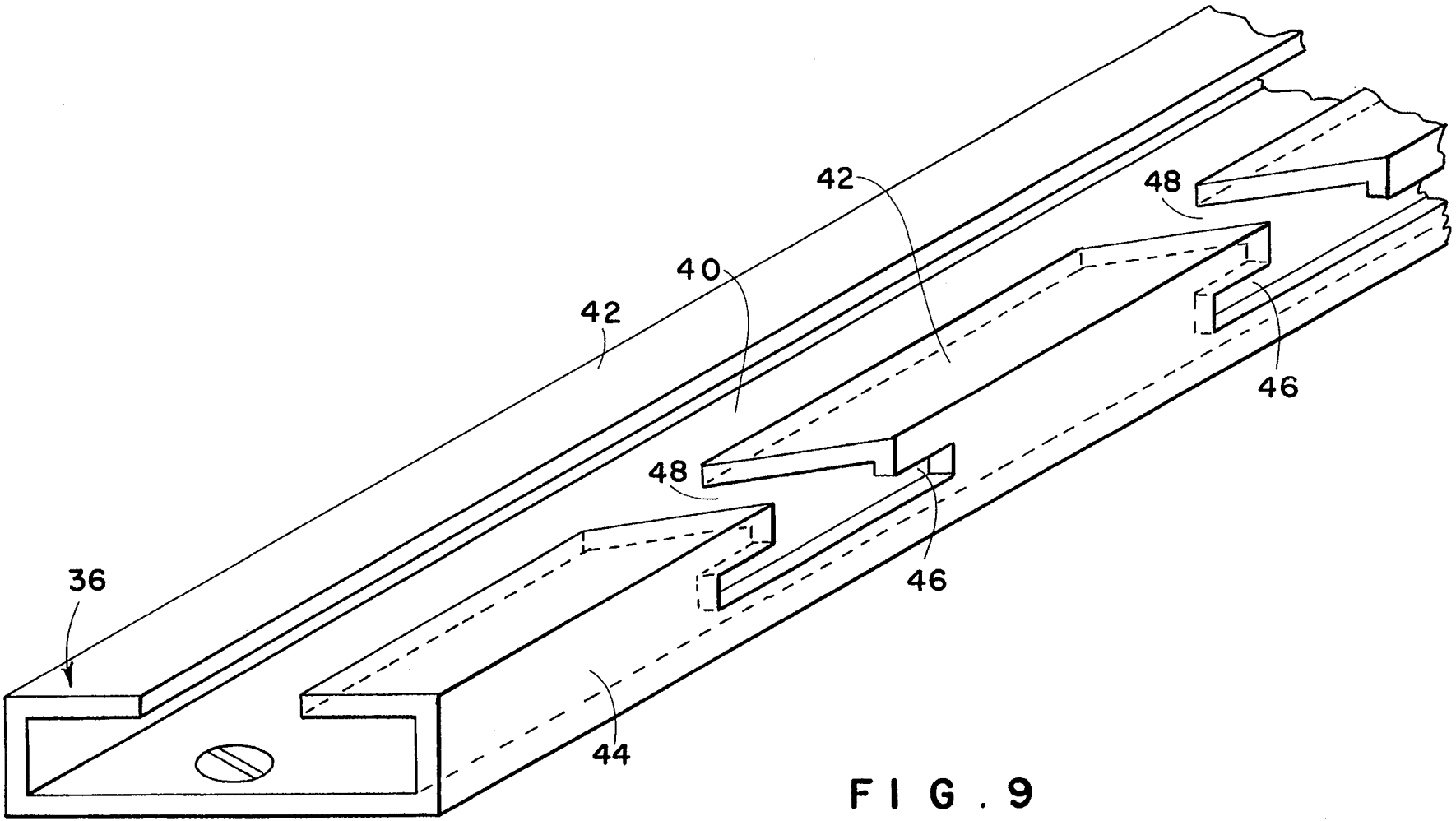
FIG. 9 is a perspective view of a mounting rail for the facing elements.
Figure 10:
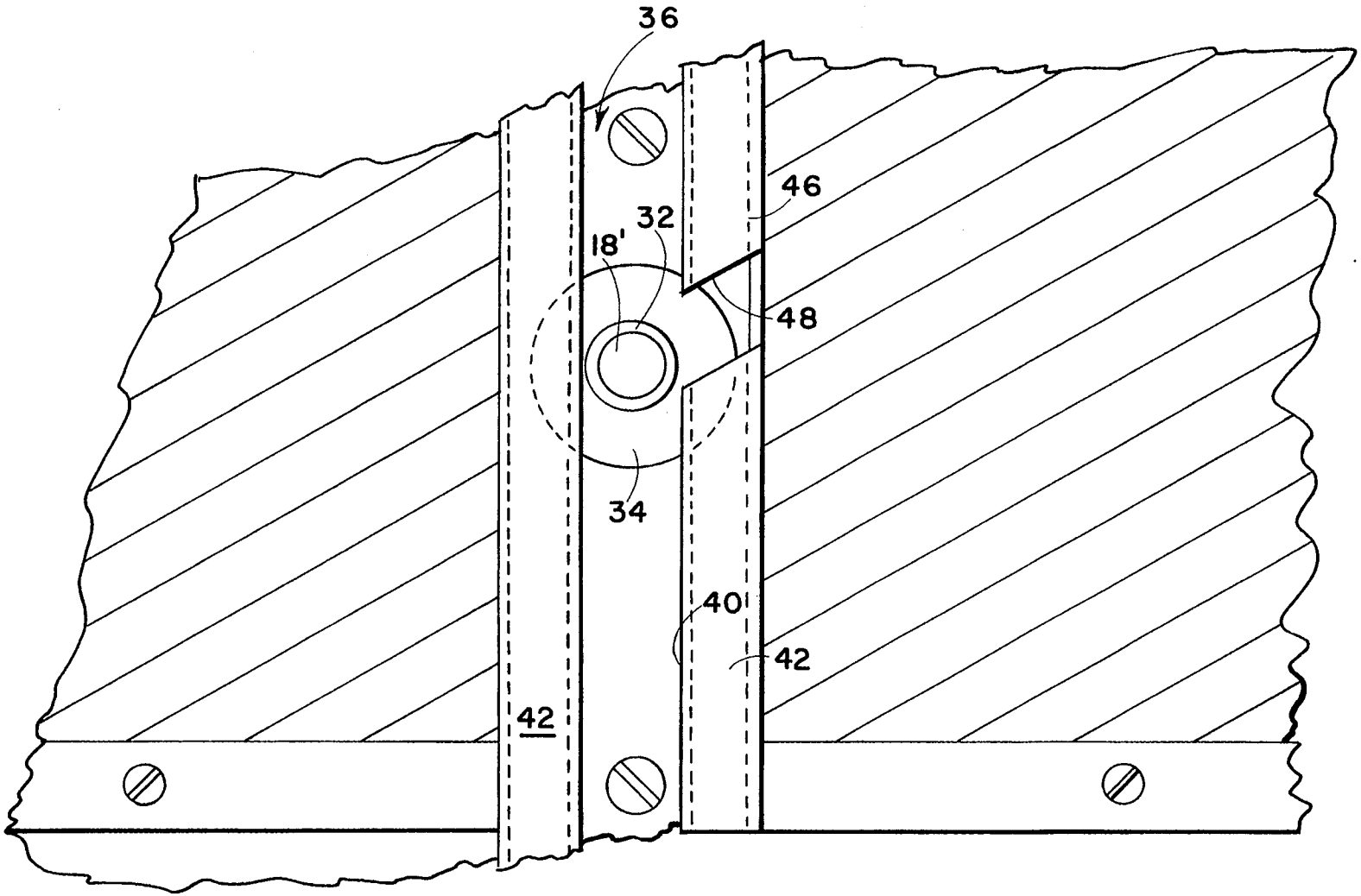
FIG. 10 is a partially cut view of the mounting rail on a building wall with the portion of the anchor engaging the rail.

In FIG. 5 and FIG. 6, the anchors 18' project beyond the lower cover plate 16 and comprise a screwed-on abutment 28. Anchor 18' comprises a screw whose head is essentially flush with the top side of the cover plate 14 and at most projects into the adhesive layer 20. The abutment 28 comprises a hexagonal collar 30 for clamping. The collar 30 is adjoined by a mounting shaft 32 which connects the collar 30 with a circular bearing flange 34. The abutment 28 comprises continuous inner threads. Collar 30, mounting shaft 32 and bearing flange 34 form the integral abutment 28. The bearing flange 34 fits into a C-form mounting rail 36 which in known manner is screwed to a building wall by means of screws 38 and dowels not further shown. The mounting rail 36 is depicted in detail in FIG. 9. It comprises a longitudinal slot 40 between the two cover walls 42 and the width of this longitudinal slot 40 is dimensioned so that the shaft 32 of the abutment fits into this space. The distance of the collar 30 from the bearing flange 34, which corresponds to the length of the shaft, is slightly larger than the thickness of the cover walls 42 so that they fit into the space between band 30 and bearing flange 34. The diameter of the bearing flange 34 whose contour is evident in FIG. 10, is approximately equal to the internal width of rail 36. The rail 36 comprises in a side wall 44 a number of rectangular openings 46 spaced at a precise distance one from the other, through which fit the bearing flange 34 of anchors 18'. Each of the openings 46 is adjoined in the bordering cover wall 42 by a connection slot 48 which terminates in the longitudinal slot 40. The connection slot 48 forms with the transverse direction of the rail 36 an angle of at least approximately 30° and, with a vertically mounted rail 36, the connection slot 48 extends from the rail side wall obliquely downward to the longitudinal slot 40. The width of the connection slot 48 is smaller than that of the opening 46 and approximately equal to the diameter of the mounting shaft 32.

Figure 8:
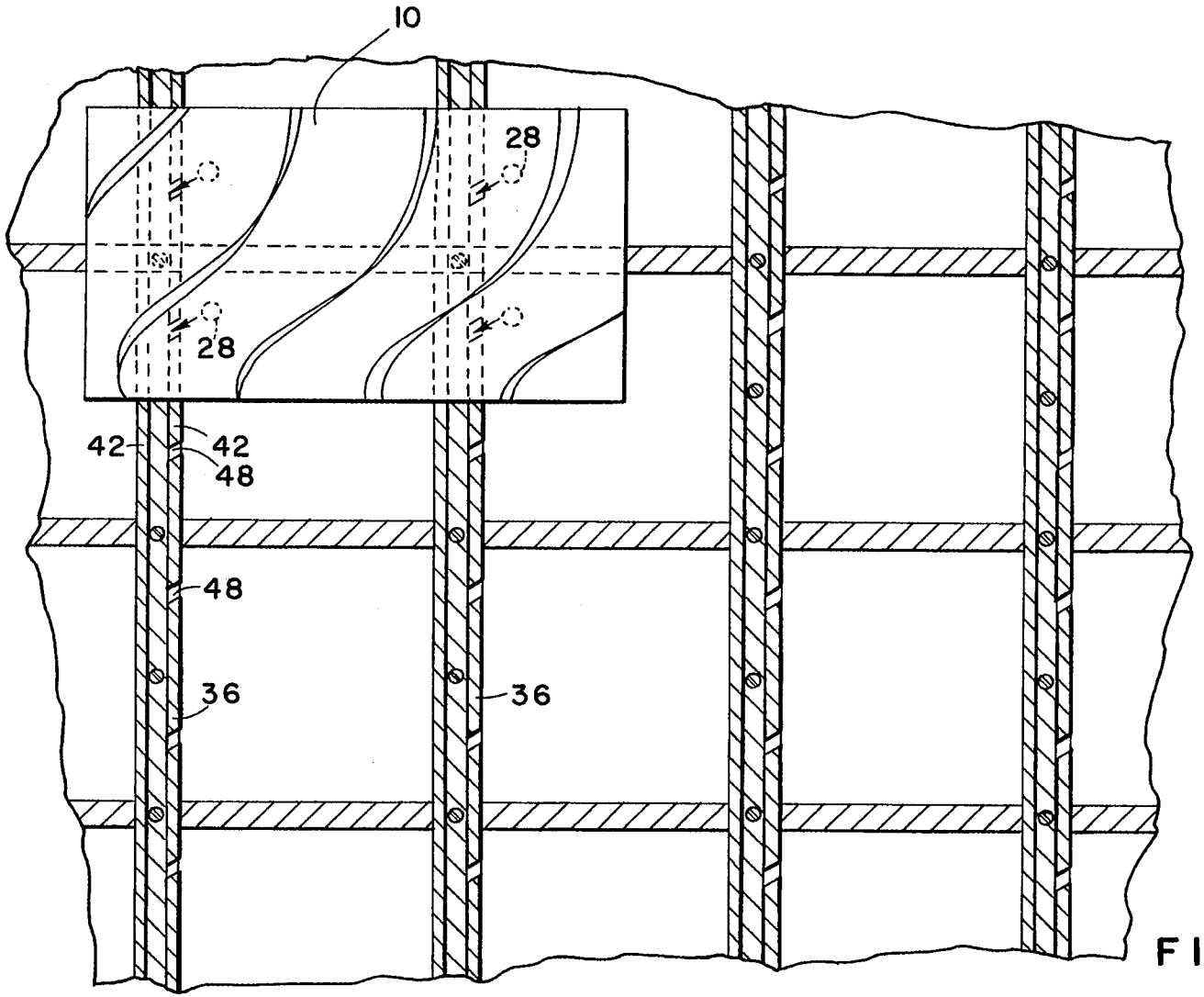
FIG. 8 is a view of a system of mounting rails for mounting the facing elements.

The facing plates 10 are suspended from the fastening rails 36 from the side as illustrated in FIG. 8. The four bearing flanges 34 of the abutments 28 are moved into the lateral rail openings 46, whereupon the shafts 32 are brought into the connection slots 48. Therein the facing plate 10 slides to the left as well as also downward until the shaft 32 abuts the edge of the particular left-side cover wall 42 (FIG. 8). Approximately diametrically opposite the sleeve 32 subsequently is braced on the corner between the lower edge of the connection slot 48 and the edge of the right-side cover wall 42 (FIG. 10). Due to this oblique plug-in of the abutments 28 into the fastening rails 36 from the side, the two differently contoured edges of the carrier plate 12 are brought into the complementary edge configurations of the two adjacent carrier plates of the previously suspended facing elements. The form-fit connection at both edges at a right angle to each other of the facing elements consequently takes place simultaneously.

Figure 7:
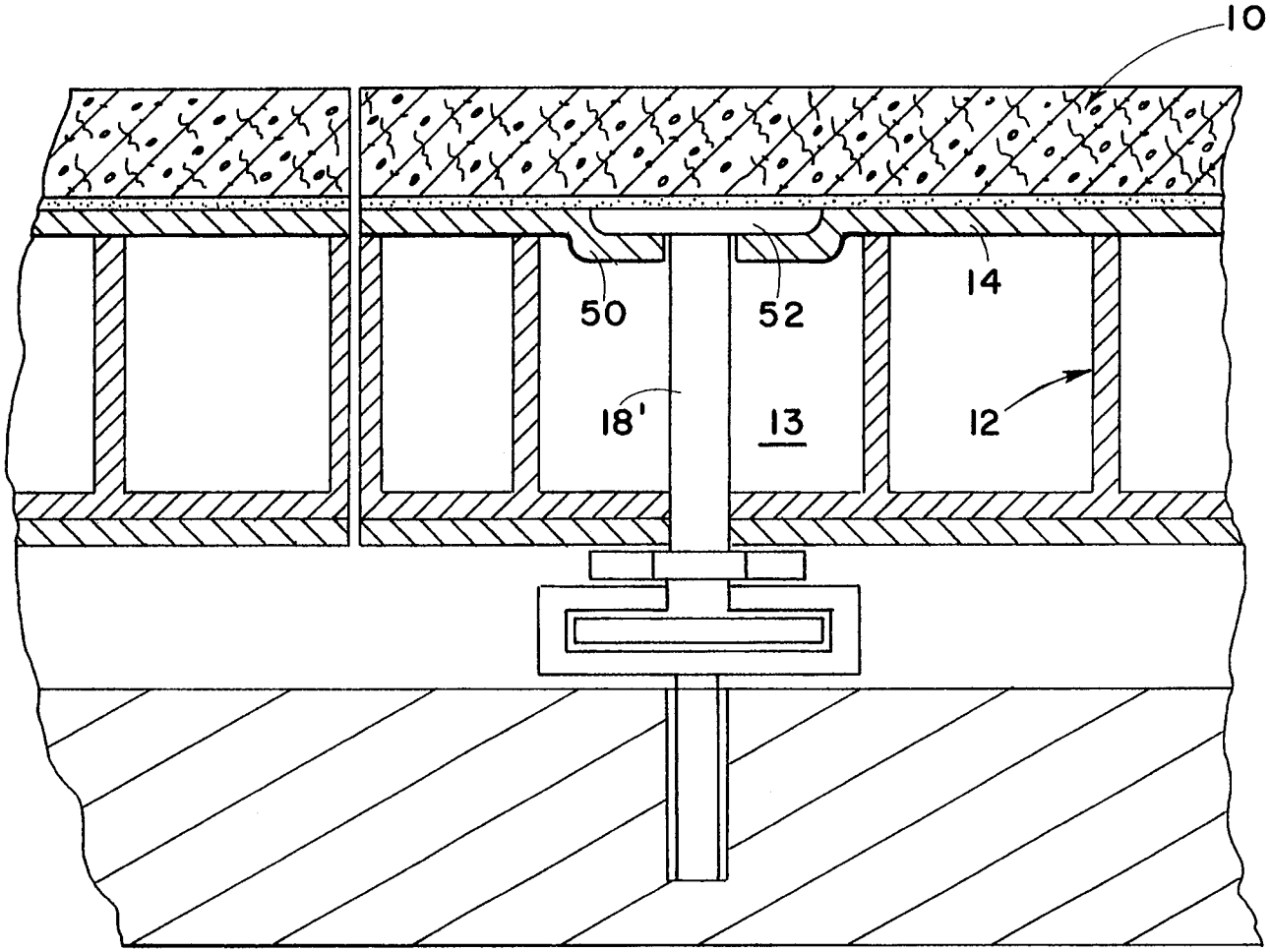
FIG. 7 is a sectional view similar to FIG. 6, however in a slightly modified embodiment.

FIG. 7 illustrates a slight modification of a facing element 10 in so far as the separate cover-side plate 14 is provided with four recessed deformations 50. These deformations 50 are implemented so that they fit form-fittingly into the contour of a hollow space 13 of the carrier plate 12. The depressions 50, for one, reinforce the plate 14 and serve for receiving a broad head 52 of anchor 18 or 18'.

Instead of the C-rail, a rail with box-form hollow profile can also be used, thus with a continuous cover wall. The connection slots in that case extend by one half of the anchor shaft diameter beyond the longitudinal rail center.

Instead of hexagon honeycombs, the carrier plate 12 can also, for example, comprise circular honeycombs. The projections in that case comprise at both diagonal edges of the carrier plate a circle segment contour. However, only line contacts result in the interdigitation instead of the areal contacts in the case of hexagonal honeycombs.

Lastly, it should be pointed out that it is indeed advantageous but not absolutely necessary to implement the honeycombs in the form of a regular hexagon, rather, the parallel sides of the hexagon, thus the sides extending parallel to the edges of the cover plate, can also be longer or shorter than the remaining sides. Therewith the plug-in angle changes also. These parallel sides can also shrink to the value 0 so that the hexagon becomes a parallelogram or a rhomboid. Such rectangular oblique-angled honeycomb cross sections are expressly included under the protection of the invention. In this case the projections can be triangular at both diagonal plate edges and, in the case of a square, their acute angle is 90°. The plug-in angle of the facing element into the connection in that case is 45°.

While a specific embodiment of the invention has been shown and described in detail to illustrate the application of the principles of the invention, it will be understood that the invention may be embodied otherwise without departing from such principles.

What is claimed is:

1. A facing element assembly for floors, ceilings, walls and the like, comprising:

a honeycomb carrier plate (12) having four edges including two pairs of diagonal edges forming corners of the carrier plate, two of the diagonal edges having a plurality of form projections (21, 23), and a remaining two of the diagonal edges having form recesses (25, 27) complimentary to the form projections (21, 23);

a rectangular top cover plate (14) on a top of the carrier plate;

a rectangular bottom cover plate (16) on a bottom of the carrier plate;

the form projections (21, 23) of the carrier plate projecting beyond the respective two of the diagonal edges of the cover plates (14, 16), and the two of the remaining diagonal edges of the cover plates (14, 16) extending beyond the form recesses (25, 27);

a plurality of mechanical anchors (18) connecting the top and bottom cover plates to each other with the carrier plate sandwiched therebetween;

a stone plate (22) connected on the top cover plate (14) and having at least substantially the same shape as the top cover plate;

the carrier plate with top and bottom cover plates, anchors and stone plate, together forming a facing element (10), the shapes of the projections and recesses of the carrier plate being selected so that with four additional facing elements engaging four respective sides of a central facing element, projections of one facing element engage into recesses of another facing element with a top cover plate and a bottom cover plate of the one facing element overlapping an area of engagement between the facing elements;

a plurality of mounting shafts (32) projecting beyond the bottom cover plate (16);

a bearing flange (34) at an end of each mounting shaft (32), each bearing flange (34) being at a distance from the bottom cover plate (16) and being wider relative to its representive mounting shaft (32); and two slotted mounting rails (36) to be fastened on a building face for mounting the facing element (10) to the building face, the mounting rails being provided to receive the mounting shafts (32) which are suspended with their bearing flanges (34) in the rails, the rails each comprising a hollow profile with essentially rectangular cross section and a bottom wall, two side walls and a cover wall (42), and in one side wall (44) a number of insertion openings (46) provided for receiving the bearing flange (34), the insertion openings, each being adjoined by a respective connection slot (48) provided in the adjoining cover wall (42), whose width is smaller than that of the insertion opening (46), but is at least as large as the width of the mounting shaft (32) for receiving the mounting shaft.

2. A facing element assembly as stated in claim 1, wherein the edges of the top cover plate (14) are aligned with the edges of the bottom cover plate (16), and the recesses (25, 27) of the carrier plate (12) form blind-hole plug-in pockets for the projections (21, 23) of adjoining carrier plates (12) of adjacent facing elements (10).

3. A facing element assembly stated in claim 1, wherein at least one projection (21, 23) provided at a cover plate corner of the carrier plate (12) in the plate connection is overlapped by the cover plates (14, 16) of three adjoining facing elements (10).

4. A facing element assembly stated in claim 1, wherein overall dimensions of the carrier plate (12) are greater in terms of width and length than at least one of the two cover plates (14, 16).

5. A facing element assembly stated in claim 1, wherein the stone plate (22) is disposed diagonally offset on the upper cover plate (14).

6. A facing element assembly as stated in claim 1, wherein the connection slots (48) forms with a longitudinal extent of the mounting rail (36) in each instance an acute angle in the range from about 25° to 65°.

7. A facing element assembly as stated in claim 6, wherein the angle which the connection slots (48) form with a transverse direction of the mounting rail (36) is at least approximately 30°.

8. A facing element assembly stated in claim 1, wherein the projections (21) of the one edge of the carrier plate (12) have a trapezoidal cross section and the projections (23) at the diagonally adjoining edge of the carrier plate (12) have a triangular cross section, and the trapezoidal and triangular projections (21, 23) form portions of the honeycomb wall structure of the carrier plate (12), whose honeycombs have a regular hexagonal cross section.

* * * * *